US006453611B1

(12) United States Patent
Weder et al.

(10) Patent No.: US 6,453,611 B1
(45) Date of Patent: Sep. 24, 2002

(54) METHOD OF COVERING A POT OR FLORAL GROUPING WITH A SLEEVE HAVING A BICONCAVE LOWER END

(75) Inventors: Donald E. Weder; Joseph G. Straeter, both of Highland, IL (US); Paul Fantz, Imperial, MO (US)

(73) Assignee: Southpac Trust International, Inc.

( * ) Notice: Subject to any disclaimer, the term of this patent is extended or adjusted under 35 U.S.C. 154(b) by 0 days.

(21) Appl. No.: 09/851,173

(22) Filed: May 8, 2001

Related U.S. Application Data

(63) Continuation-in-part of application No. 09/401,771, filed on Sep. 22, 1999, now Pat. No. 6,230,441, which is a continuation of application No. 08/606,957, filed on Feb. 26, 1996, now abandoned.

(51) Int. Cl.[7] ..... A47G 7/08; A47G 7/02
(52) U.S. Cl. ..... 47/72
(58) Field of Search ..... 47/72; 206/423; 53/396, 397; 383/121

(56) References Cited

U.S. PATENT DOCUMENTS

| | | | | |
|---|---|---|---|---|
| 524,219 | A | 9/1894 | Schmidt | |
| 732,889 | A | 7/1903 | Paver | |
| 950,785 | A | 3/1910 | Pene | |
| 1,044,260 | A | 11/1912 | Schloss | |
| 1,063,154 | A | 5/1913 | Bergen | |
| 1,446,563 | A | 2/1923 | Hughes | |
| 1,520,647 | A | 12/1924 | Hennigan | |
| 1,525,015 | A | 2/1925 | Weeks | |
| 1,610,652 | A | 12/1926 | Bouchard | |
| 1,697,751 | A | 1/1929 | Blake | 229/87 |
| 1,794,212 | A | 2/1931 | Snyder | 229/87 |
| 1,811,574 | A | 6/1931 | Barrett | 229/87 |
| 1,863,216 | A | 6/1932 | Wordingham | 229/87 |
| 1,978,631 | A | 10/1934 | Herrlinger | 91/68 |

(List continued on next page.)

FOREIGN PATENT DOCUMENTS

| | | |
|---|---|---|
| AU | 4231978 | 6/1979 |
| BE | 654427 | 1/1965 |
| CH | 560532 | 4/1975 |
| DE | 513971 | 11/1930 |
| DE | 1166692 | 3/1964 |
| DE | 1962947 | 6/1971 |
| DE | 2060812 | 11/1971 |
| DE | 2748626 | 5/1979 |
| DE | 3445799 | 6/1986 |
| DE | 3829281 | 5/1989 |

(List continued on next page.)

OTHER PUBLICATIONS

Speed Cover Brochure, "The Simple Solution For Those Peak Volume Periods", Highland Supply Corporation, ©1989.

(List continued on next page.)

*Primary Examiner*—Peter M. Poon
*Assistant Examiner*—Jeffrey L. Gellner
(74) *Attorney, Agent, or Firm*—Dunlap, Codding & Rogers, P.C.

(57) ABSTRACT

A floral sleeve initially having a flattened condition and openable therefrom for use in covering, containing or wrapping a floral grouping, botanical item, pot, or pot having a floral grouping or botanical item therein. The sleeve has a biconcave lower end, and may have a detachable upper portion. The sleeve may have a non-linear or linear upper edge. When having a detachable upper portion, the sleeve has a detaching element which when employed to detach the upper portion, leaves a linear, or non-linear upper edge on the lower portion of the sleeve. The biconcave lower end of the sleeve may have a gusset therein.

21 Claims, 4 Drawing Sheets

U.S. PATENT DOCUMENTS 2,048,123 A 7/1936 Howard ..... 229/87
RE21,065 E 5/1939 Copeman ..... 93/2
2,170,147 A 8/1939 Lane ..... 206/56
2,200,111 A 5/1940 Bensel ..... 229/1.5
2,278,673 A 4/1942 Savada et al. ..... 154/43
2,302,259 A 11/1942 Rothfuss ..... 41/10
2,323,287 A 7/1943 Amberg ..... 229/53
2,355,559 A 8/1944 Renner ..... 229/8
2,371,985 A 3/1945 Frieberg ..... 206/46
2,411,328 A 11/1946 MacNab ..... 33/12
2,510,120 A 6/1950 Leander ..... 117/122
2,529,060 A 11/1950 Trillich ..... 117/68.5
2,621,142 A 12/1952 Wetherell ..... 154/117
2,648,487 A 8/1953 Linda ..... 229/55
2,688,354 A 9/1954 Berger ..... 150/28
2,774,187 A 12/1956 Smithers ..... 47/41
2,822,287 A 2/1958 Avery ..... 117/14
2,846,060 A 8/1958 Yount ..... 206/58
2,850,842 A 9/1958 Eubank, Jr. ..... 47/58
2,883,262 A 4/1959 Borin ..... 21/56
2,989,828 A 6/1961 Warp ..... 53/390
3,022,605 A 2/1962 Reynolds ..... 47/58
3,080,680 A 3/1963 Reynolds ..... 47/37
3,094,810 A 6/1963 Kalpin ..... 47/37
3,121,647 A 2/1964 Harris et al. ..... 118/202
3,130,113 A 4/1964 Silman ..... 161/97
3,271,922 A 9/1966 Wallerstein et al. ..... 53/3
3,322,325 A 5/1967 Bush ..... 229/62
3,376,666 A 4/1968 Leonard ..... 47/41
3,380,646 A 4/1968 Doyen et al. ..... 229/57
3,431,706 A 3/1969 Stuck ..... 53/390
3,508,372 A 4/1970 Wallerstein et al. ..... 53/3
3,510,054 A 5/1970 Sanni et al. ..... 229/66
3,512,700 A 5/1970 Evans et al. ..... 229/53
3,550,318 A 12/1970 Remke et al. ..... 47/37
3,552,059 A 1/1971 Moore ..... 47/41.12
3,554,434 A 1/1971 Anderson ..... 229/55
3,556,389 A 1/1971 Gregoire ..... 229/53
3,557,516 A 1/1971 Brandt ..... 53/14
3,620,366 A 11/1971 Parkinson ..... 206/59
3,681,105 A 8/1972 Milutin ..... 117/15
3,767,104 A 10/1973 Bachman et al. ..... 229/7
3,793,799 A 2/1974 Howe ..... 53/32
3,869,828 A 3/1975 Matsumoto ..... 47/34.11
3,888,443 A 6/1975 Flanigen ..... 248/152
3,962,503 A 6/1976 Crawford ..... 428/40
4,043,077 A 8/1977 Stonehocker ..... 47/66
4,054,697 A 10/1977 Reed et al. ..... 428/40
4,091,925 A 5/1978 Griffo et al. ..... 206/423
4,113,100 A 9/1978 Soja et al. ..... 206/602
4,118,890 A 10/1978 Shore ..... 47/28
4,189,868 A 2/1980 Tymchuck et al. ..... 47/84
4,216,620 A 8/1980 Weder et al. ..... 47/72
4,248,347 A 2/1981 Trimbee ..... 206/423
D259,333 S 5/1981 Charbonneau ..... D9/306
4,265,049 A 5/1981 Gorewitz ..... 47/26
4,280,314 A 7/1981 Stuck ..... 53/241
4,297,811 A 11/1981 Weder ..... 47/72
4,333,267 A 6/1982 Witte ..... 47/84
4,347,686 A 9/1982 Wood ..... 47/73
4,380,564 A 4/1983 Cancio et al. ..... 428/167
4,400,910 A 8/1983 Koudstall et al. ..... 47/84
4,413,725 A 11/1983 Bruno et al. ..... 206/45.33
D279,279 S 6/1985 Wagner ..... D11/143
4,546,875 A 10/1985 Zweber ..... 206/0.82
4,621,733 A 11/1986 Harris ..... 206/423
4,640,079 A 2/1987 Stuck ..... 53/390
4,717,262 A 1/1988 Roen et al. ..... 383/120
4,733,521 A 3/1988 Weder et al. ..... 53/580
4,765,464 A 8/1988 Ristvedt ..... 206/0.82
4,771,573 A 9/1988 Stengel ..... 47/67
4,773,182 A 9/1988 Weder et al. ..... 47/72
4,801,014 A 1/1989 Meadows ..... 206/423
4,810,109 A 3/1989 Castel ..... 383/105
4,835,834 A 6/1989 Weder ..... 29/525
D301,991 S 7/1989 Van Sant ..... D11/149
4,941,572 A 7/1990 Harris ..... 206/423
4,980,209 A 12/1990 Hill ..... 428/34.1
4,989,396 A 2/1991 Weder et al. ..... 53/397
D315,700 S 3/1991 Stephens ..... D11/151
5,073,161 A 12/1991 Weder et al. ..... 493/154
5,074,675 A 12/1991 Osgood ..... 383/122
5,105,599 A 4/1992 Weder ..... 53/399
5,111,638 A 5/1992 Weder ..... 53/397
5,120,382 A 6/1992 Weder ..... 156/212
5,152,100 A 10/1992 Weder et al. ..... 47/72
5,181,364 A 1/1993 Weder ..... 53/397
D335,105 S 4/1993 Ottenwalder et al. ..... D11/164
5,199,242 A 4/1993 Weder et al. ..... 53/397
5,205,108 A 4/1993 Weder et al. ..... 53/397
5,228,234 A 7/1993 de Klerk et al. ..... 47/41.01
5,235,782 A 8/1993 Landau ..... 47/72
5,239,775 A 8/1993 Landau ..... 47/72
5,249,407 A 10/1993 Stuck ..... 53/399
5,259,106 A 11/1993 Weder et al. ..... 29/469.5
5,307,606 A 5/1994 Weder ..... 53/410
5,315,785 A 5/1994 Avôt et al. ..... 47/72
5,350,240 A 9/1994 Billman et al. ..... 383/104
5,353,575 A 10/1994 Stepanek ..... 53/461
5,361,482 A 11/1994 Weder et al. ..... 29/469
5,388,695 A 2/1995 Gilbert ..... 206/423
5,428,939 A 7/1995 Weder et al. ..... 53/397
5,443,670 A 8/1995 Landau ..... 156/191
5,493,809 A 2/1996 Weder et al. ..... 47/72
D368,025 S 3/1996 Sekerak et al. ..... D9/305
5,496,251 A 3/1996 Cheng ..... 493/224
5,496,252 A 3/1996 Gilbert ..... 493/224
5,526,932 A 6/1996 Wedre ..... 206/423
5,551,570 A 9/1996 Shaffer et al. ..... 206/575
5,564,256 A * 10/1996 Weder ..... 53/397
5,572,849 A 11/1996 Weder et al. ..... 53/399
5,572,851 A 11/1996 Weder ..... 53/399
5,575,133 A 11/1996 Weder et al. ..... 53/397
5,617,703 A 4/1997 Weder ..... 53/413
5,624,320 A 4/1997 Martinez ..... 472/51
5,625,979 A 5/1997 Weder
5,647,168 A 7/1997 Gilbert ..... 47/72
5,647,193 A 7/1997 Weder et al. ..... 53/465
5,715,944 A 2/1998 Windisch ..... 206/423
D404,684 S 1/1999 Shea ..... D11/164
D419,436 S 1/2000 Celtorius et al. ..... D9/305
6,129,209 A 10/2000 Tchira ..... 206/423
6,182,395 B1 * 2/2001 Weder et al. ..... 47/72
6,185,904 B1 * 2/2001 Weder et al. ..... 53/397
6,230,441 B1 * 5/2001 Weder et al. ..... 47/72
6,298,601 B1 * 10/2001 Weder et al. ..... 47/72
6,341,446 B2 * 1/2002 Weder et al. ..... 47/72
6,360,485 B1 * 3/2002 Weder et al. ..... 47/72

FOREIGN PATENT DOCUMENTS

DE 3911847 10/1990
DE 345464 12/1991
EP 0050990 5/1982
EP 0791543 8/1997
FR 1376047 9/1964
FR 2036163 12/1970
FR 2137325 12/1972
FR 2272914 12/1975
FR 2489126 3/1982
FR 2610604 8/1988
FR 2603159 3/1989

| | | |
|---|---|---|
| FR | 2619698 | 3/1989 |
| GB | 5605 | of 1885 |
| GB | 1204647 | 9/1970 |
| GB | 2056410 | 3/1981 |
| GB | 2074542 | 11/1981 |
| GB | 2128083 | 4/1984 |
| GB | 225708 | 8/1992 |
| IT | 224507 | 4/1996 |
| JP | 542958 | 2/1993 |
| NL | 8301709 | 12/1984 |
| NL | 1000658 | 1/1996 |
| WO | 9315979 | 8/1993 |

OTHER PUBLICATIONS

"Speed Sheets and Speed Rolls" Brochure, Highland Supply Corporation, ©1990.

"Color Them Happy with Highlander Products" ©1992.

"Costa Keeps the Christmas Spirit", Supermarket Floral, Sep. 15, 1992.

"Super Seller", Supermarket Floral, Sep. 15, 1992.

"Halloween", Link Magazine, Sep. 1992.

"Now More Than Ever", Supermarket Floral, Sep. 15, 1992.

Le Plant Sac Advertisement, published prior to Sep. 26, 1987.

"A World of Cut Flower and Pot Plant Packaging" Brochure, Klerk's Plastic Products Manufacturing, Inc., published prior to Mar. 31, 1994, 6 pages.

Chantler & Chantler brochure showing Zipper Sleeve™ and Florasheet®, published prior to Mar. 31, 1994, 2 pages.

"Stand Alone Plastic Bagmaking" brochure, AMI, Atlanta, GA, Feb. 15, 1996, 2 pages.

"Foll Jackets" brochure, Custom Medallion, Inc., Dec., 1996, 2 pages.

"Derwent Abstract" of FR 2610604A. It is noted that the abstract is an incorrect English translation of the contents of the French patent. The French patent does not enable or disclose adhesively attaching the covering to the container. 1988.

"Silver Linings" Brochure, Affinity Diversified Industries, Inc., 1986. The Silver Linings brochure shows a floral sleeve with a closed bottom. The brochure shows, in one embodiment, a vase with flowers inside a "cut flower" sleeve with the sleeve tied with a ribbon about the neck of the vase.

"Special Occasion Printed Highlophane Bags" Brochure, Highland Supply Corporation, 1990, 2 pages.

"Creative Packaging" Brochure, John Henry Company, Sep. 1992.

"Make Highlander Your Headquarters" Brochure, Highland Supply Corporation, 1991.

* cited by examiner

METHOD OF COVERING A POT OR FLORAL GROUPING WITH A SLEEVE HAVING A BICONCAVE LOWER END

CROSS REFERENCE TO RELATED APPLICATIONS

The present application is a continuation-in-part of U.S. Ser. No. 09/401,771, filed Sep. 22, 1999, now U.S. Pat. No. 6,230,441 B1, which is a continuation of U.S. Ser. No. 08/606,957, filed Feb. 26, 1996, now abandoned.

FIELD OF THE INVENTION

This invention generally relates to sleeves, and more particularly, to sleeves used to wrap floral groupings or flower pots containing floral groupings and/or mediums containing floral groupings, and methods of using same. U.S. Pat. Nos. 5,625,979 and 5,493,809 and pending U.S. Ser. No. 09/189,033 disclose subject matter which may be relevant to the invention contemplated and claimed herein and are hereby expressly incorporated herein by reference in their entirety.

DESCRIPTION OF THE PREFERRED EMBODIMENTS

Figure 1:
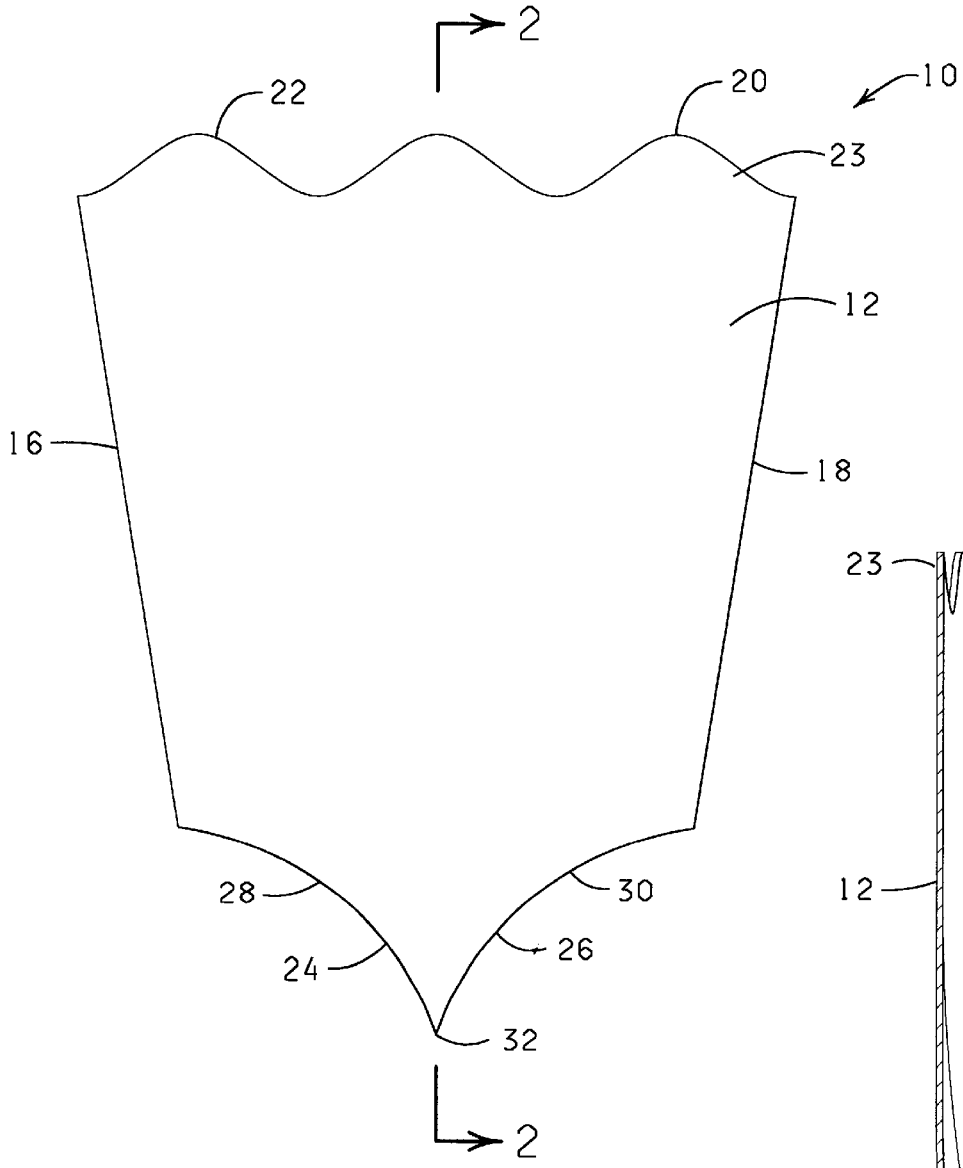
FIG. 1 is an elevational view of a sleeve constructed in accordance with the present invention.
Figure 2:
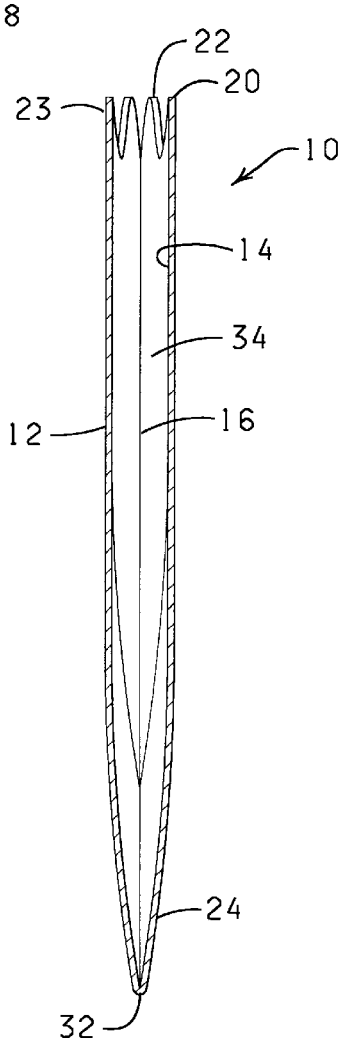
FIG. 2 is a cross-sectional view of the sleeve of FIG. 1 taken along line 2—2.
Figure 3:
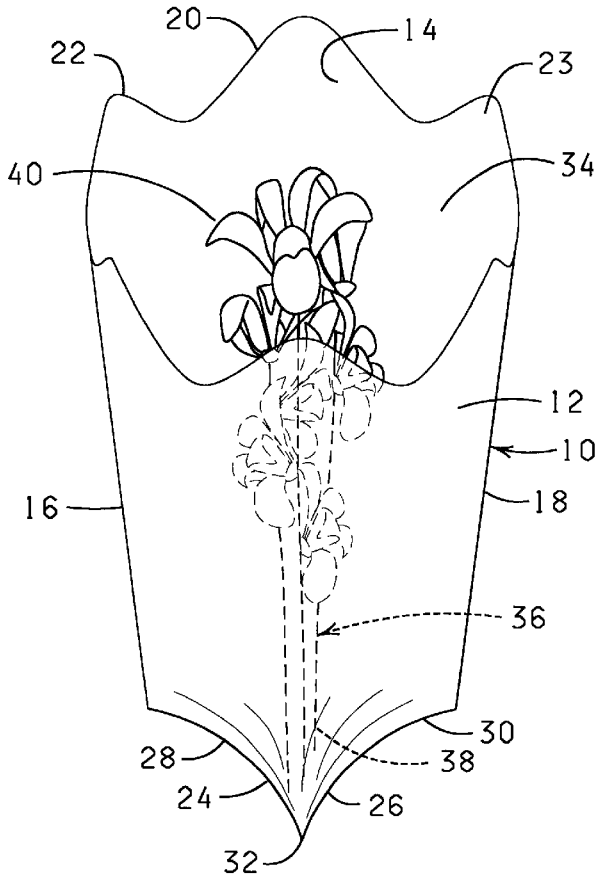
FIG. 3 is a perspective view of a sleeve such as the sleeve in FIG. 1 having a floral grouping therein.

The present invention contemplates in a preferred version a preformed sleeve (also referred to herein as a "floral sleeve" or simply as a "sleeve") having a tubular shape sized to contain and conform to a flower pot having a upper end, a lower end and an outer peripheral surface. The sleeve may further comprise a detachable upper portion which may be sized to surround and encompass a floral grouping.

The sleeve may form part of a plant package when used in conjunction with a floral grouping or a pot having a floral grouping and wherein the pot and/or floral grouping is substantially surrounded and encompassed by the sleeve.

The floral grouping is at least partially surrounded and encompassed and may be entirely enclosed by the upper portion when it forms a part of the sleeve.

Also, the sleeve may have a bonding material disposed on an inner portion thereof for bondingly connecting to a pot disposed therein. Alternatively, the bonding material may be disposed on an outer portion of the sleeve for forming a plurality of crimps in a portion of the sleeve.

When present, the lower portion of the sleeve may be constructed from a first material and the upper portion (when present) may be constructed from the first material or a second material different from the first material.

These embodiments and others of the present invention are now described in more detail below. It will be appreciated that the examples provided herein are not intended to limit the scope and extent of the claimed invention but are only intended to exemplify various embodiments of the invention contemplated herein.

Turning now to the drawings, shown in FIGS. 1–4 is a floral sleeve designated by the general reference numeral 10. Shown in FIGS. 1–4 is a sleeve designated by the general reference numeral 10. Sleeve 10 has an outer peripheral surface 12, an inner peripheral surface 14, a first sidewall edge 16, a second sidewall edge 18, an upper end 20 having an upper edge 22, a skirt portion 23, a lower end 24 (also referred to herein as biconcave lower end 24) having a lower edge 26, a terminal end 32 and an inner space 34. The lower edge 26 has a first concave edge 28 and a second concave edge 30, thereby causing the lower end 24 to have a biconcave shape. The first concave edge 28 extends from the first sidewall edge 16 and the second concave edge 30 extends from the second sidewall edge 18 with the first and second concave edges 28 and 30 meeting generally near the terminal end 32. The first concave edge 28 and the second concave edge 30 are curved inwardly toward the inner space 34 of the sleeve 10.

The sleeve 10 is preferably individually sized so that a standard sized flower pot, such as a 3-inch, 3½-inch, 4-inch, 4½-inch, 5-inch, 5½-inch, 6-inch, 6½-inch, 7-inch or 8-inch pot, for example, can fit within the sleeve 10, with the pot substantially conforming to the inner peripheral surface 14 of the sleeve 10. The sleeve 10 preferably has a tapered, frustoconical shape, but may also have a rectangular or cylindrical shape, except for the biconcave lower end 24 described herein. The sleeve 10 is initially formed to have a flattened condition and is openable therefrom to an open state for containing a floral grouping or a floral container such as a flower pot as described elsewhere herein.

Figure 4:
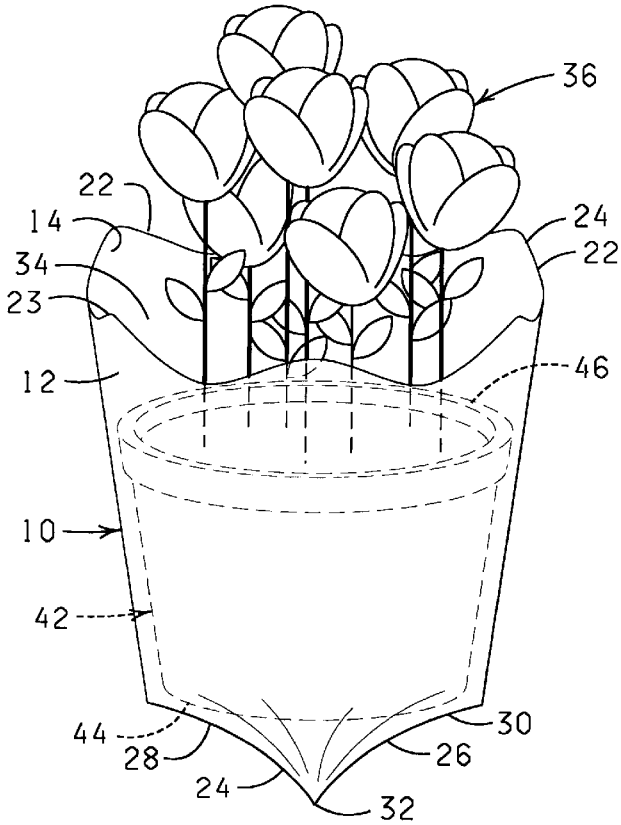
FIG. 4 is a perspective view of the sleeve of FIG. 1 having a pot and floral grouping therein.

In a preferred version of the invention, the sleeve 10, as shown in FIGS. 1–4, the upper edge 22 of the upper end has a non-linear pattern, such as a curve, wave, arc or serration. The upper edge 22 and the upper end 20 forms the skirt portion 23 of the sleeve 10 for decorating a floral grouping 36 having a stem portion 38 and a bloom portion 40 disposed therein (FIG. 3) or a pot 42 having a lower end 44 and an upper end 46 (FIG. 4). The pot 42 contains the floral grouping 36. Other nonlinear configurations of the upper edge 22 of the skirt portion 23 will be readily apparent to one of ordinary skill in the art, for example, those shown in FIGS. 11–16 of U.S. Ser. No. 09/401,771, the entire specification of which is hereby expressly incorporated herein by reference.

Figure 5:
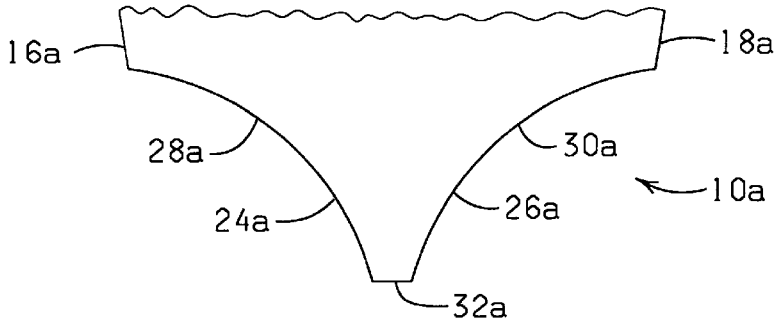
FIG. 5 is a fragmental elevational view of another embodiment of a sleeve constructed in accordance with the present invention.

Shown in FIG. 5 in a fragmented view and designated therein by the general reference numeral 10*a* is an alternate embodiment of a sleeve of the present invention. Sleeve 10*a* has a first sidewall edge 16*a*, a second sidewall edge 18*a*, a lower end 24*a*, a lower edge 26*a*, a first concave edge 28*a* and a second concave edge 30*a*. Sleeve 10*a* is similar to sleeve 10 except sleeve 10*a* has a terminal end 32*a* which has an aperture therein for allowing drainage from the sleeve 10*a*.

Figure 6:
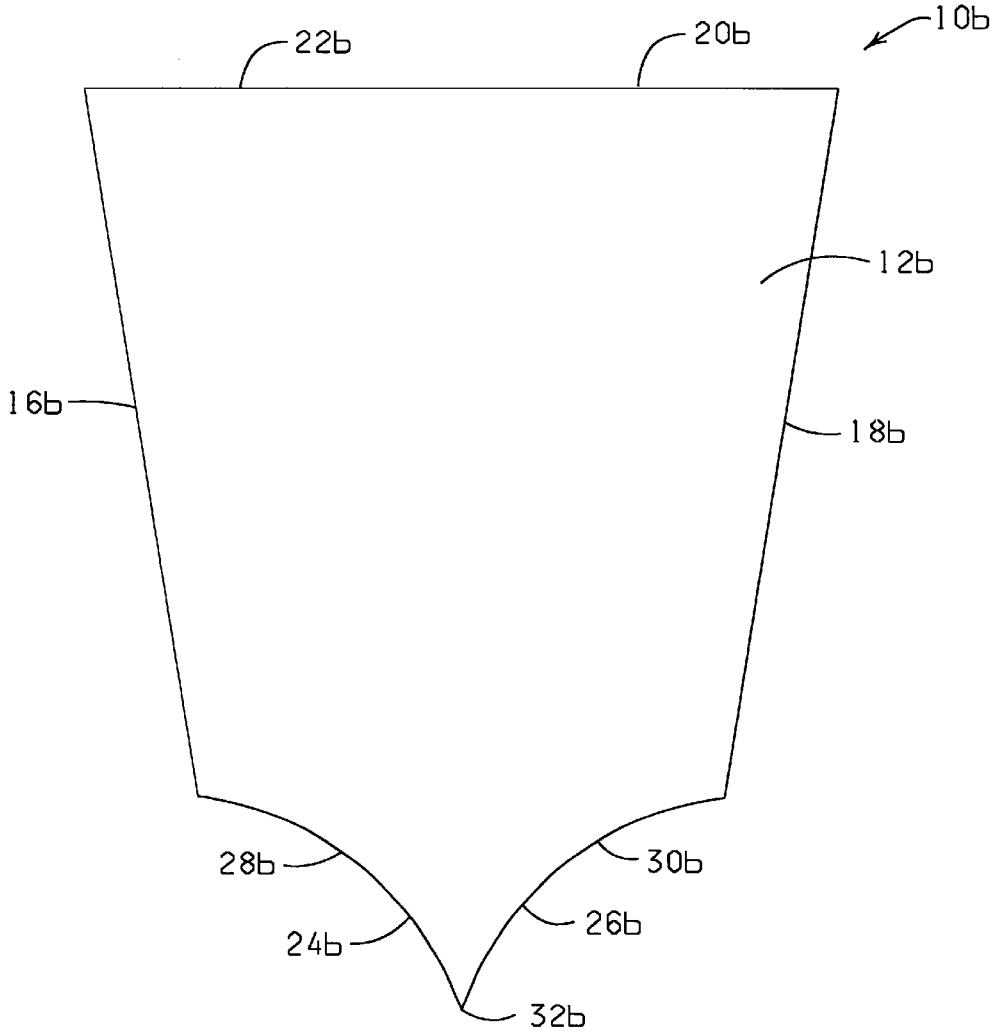
FIG. 6 is an elevational view of another embodiment of a sleeve constructed in accordance with the present invention.

Shown in FIG. 6 is a sleeve designated by the general reference numeral 10*b*. Sleeve 10*b* is generally similar to sleeve 10 or sleeve 10*a*. Sleeve 10*b* has an outer peripheral surface 12*b*, a first sidewall edge 16*b*, a second sidewall edge 18*b*, an upper end 20*b* having an upper edge 22*b*, a lower end 24*b* (also referred to herein as biconcave lower end 24*b*) having a lower edge 26*b*, and a terminal end 32*b*. The lower edge 26*b* has a first concave edge 28*b* and a second concave edge 30*b*, thereby causing the lower end 24*b* to have a biconcave shape. The first concave edge 28*b* extends from the first sidewall edge 16*b* and the second concave edge 30*b* extends from the second sidewall edge 18*b* with the first and second concave edges 28*b* and 30*b* meeting generally near the terminal end 32*b*. The first concave edge 28*b* and the second concave edge 30*b* are curved inwardly toward an inner space (not shown) of the sleeve 10*b*. Sleeve 10*b* differs from sleeve 10 or 10*a* primarily in that the upper edge 22*a* is linear rather than non-linear.

Figure 7:
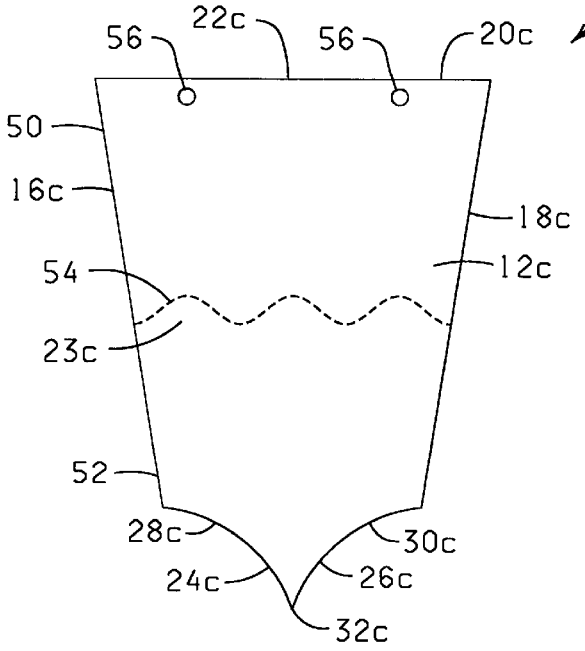
FIG. 7 is an elevational view of another embodiment of a sleeve constructed in accordance with the present invention.

Shown in FIG. 7 is a sleeve designated by the general reference numeral 10*c* which is similar to sleeves 10–10*b* except as described below. Sleeve 10*c* has an outer peripheral surface 12*c*, a first sidewall edge 16*c*, a second sidewall edge 18*c*, an upper end 20*c* having an upper edge 22*c*, a skirt portion 23*c*, a lower end 24*c* (also referred to herein as biconcave lower end 24*c*) having a lower edge 26*c*, and a terminal end 32*c*. The lower edge 26*c* has a first concave edge 28*c* and a second concave edge 30*c*, thereby causing the lower end 24*c* to have a biconcave shape as explained previously. Sleeve 10*c* is similar to sleeves 10–10*b* shown in FIGS. 1–6 except sleeve 10*c* comprises both an upper portion 50 and a lower portion 52. The upper portion 50 is detachable from the lower portion 52 via a detaching element 54, such as perforations. The upper portion 50 generally is sized so that it can substantially surround and encompass the floral grouping 36 alone or disposed within the pot 42 disposed within the sleeve 10*c*. The upper portion 50 may have apertures 56 therein for enabling the sleeve 10*c* to be supported from a support device or assembly such as a wicket, in a manner well known to persons of ordinary skill in the art.

Figure 8:
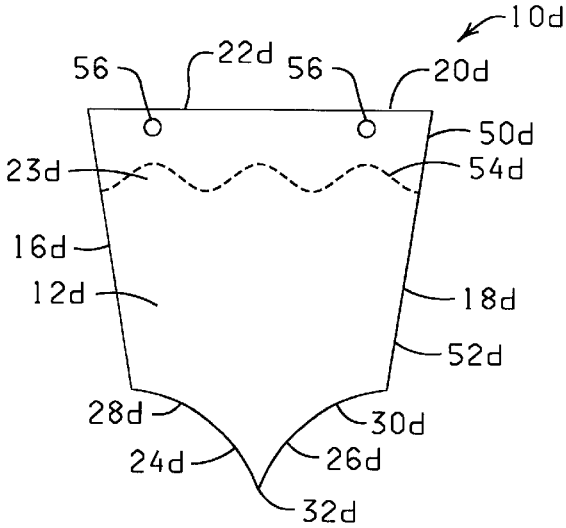
FIG. 8 is an elevational view of another embodiment of a sleeve constructed in accordance with the present invention.

Shown in FIG. 8 is a sleeve designated by the general reference numeral 10*d* which is similar to sleeve 10*c* except as described below. Sleeve 10*d* has an outer peripheral surface 12*d*, a first sidewall edge 16*d*, a second sidewall edge 18*d*, an upper end 20*d* having an upper edge 22*d*, a skirt portion 23*d*, a lower end 24*d* (also referred to herein as biconcave lower end 24*d*) having a lower edge 26*d*, and a terminal end 32*d*. The lower edge 26*d* has a first concave edge 28*d* and a second concave edge 30*d*, thereby causing the lower end 24*d* to have a biconcave shape as described previously. Sleeve 10*d* comprises an upper portion 50*d*, and a lower portion 52*d*. Upper portion 50*d* is detachable via a detaching element 54*d* such as perforations as described for sleeve 10*c*. The upper portion 50*d* may be constructed with apertures 56 therein for enabling the sleeve 10*d* to be supported by a support device such as a wicket, in a manner well known to a person of ordinary skill in the art. The upper portion 50*d* of the sleeve 10*d* is designed to be removed from the lower portion 52*d* of the sleeve 10*d* before the lower portion 52*d* is used to cover a pot 42 or a floral grouping 36, and thus is not sized to enclose the floral grouping 36 unlike sleeve. 10*c*.

Figure 9:
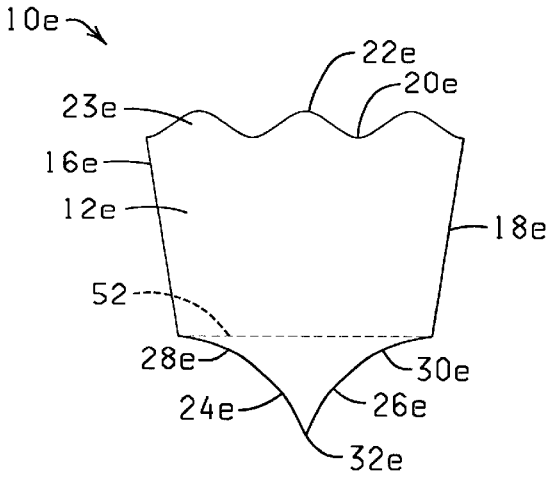
FIG. 9 is an elevational view of another embodiment of a sleeve constructed in accordance with the present invention.

Shown in FIG. 9 is a sleeve designated by the general reference numeral 10*e* which is similar to sleeve 10–10*d* except as described below. Sleeve 10*e* has an outer peripheral surface 12*e*, a first sidewall edge 16*e*, a second sidewall edge 18*e*, an upper end 20*e* having an upper edge 22*e*, a skirt portion 23*e*, a lower end 24*e* (also referred to herein as biconcave lower end 24*e*) having a lower edge 26*e*, and a terminal end 32*e*. The lower edge 26*e* has a first concave edge 28*e* and a second concave edge 30*e*, thereby causing the lower end 24*e* to have a biconcave shape as explained previously. Sleeve 10*e* is similar to sleeve 10 shown in FIG. 1 (or other sleeves 10–10*d* shown herein) except sleeve 10*e* has a gusset 52 in the lower end 24*e* thereof. The gusset 52 further enables the biconcave lower end 24*e* to be expanded to more completely accommodate floral grouping 36 or pot 42. Gussets and their construction are well known to persons of ordinary skill in the art, therefore further discussion of their methods of construction is not deemed necessary herein.

Figure 10:
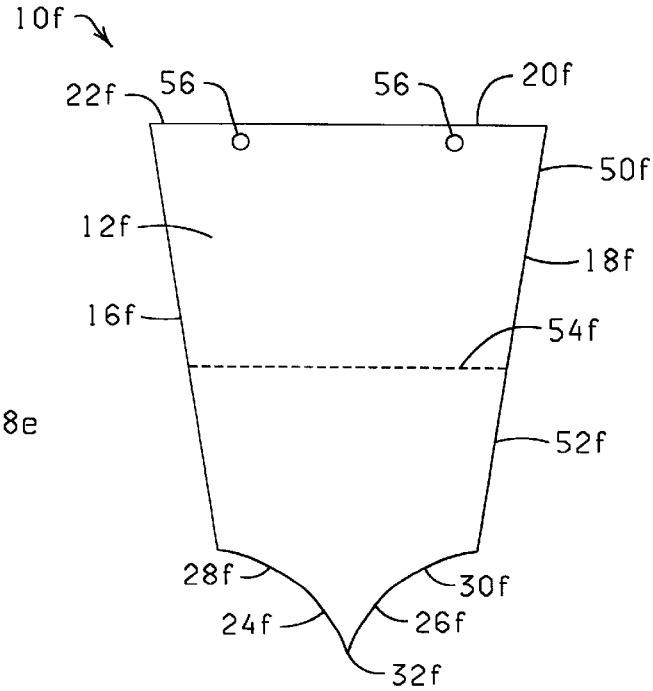
FIG. 10 is an elevational view of another embodiment of a sleeve constructed in accordance with the present invention.

Shown in FIG. 10 is a sleeve designated by the general reference numeral 10*f* which is similar to sleeve 10*c* except as explained below. Sleeve 10*f* has an outer peripheral surface 12*f*, a first sidewall edge 16*f*, a second sidewall edge 18*f*, an upper end 20*f* having an upper edge 22*f*, a lower end 24*f* (also referred to herein as biconcave lower end 24*f*) having a lower edge 26*f*, and a terminal end 32*f*. The lower edge 26*f* has a first concave edge 28*f* and a second concave edge 30*f*, thereby causing the lower end 24*f* to have a biconcave shape as explained elsewhere herein. Sleeve 10*f* comprises an upper portion 50*f* and a lower portion 52*f*. Upper portion 50*f* is detachable via a detaching element 54*f*, such as perforations as described herein before. The upper portion 50*f* may be constructed with apertures 56 thereon for enabling the sleeve 10*f* to be supported by a support device such as a wicket.

Sleeve 10*f* differs from sleeve 10*c* primarily in that the detaching element 54*f* has a linear or arcuate pattern extending from first sidewall edge 16*f* to second sidewall edge 18*f* rather than a non-linear pattern as shown for detaching element 54 of sleeve 10*c*. Any of the sleeves contemplated herein may also be equipped with drainage elements (e.g., one or more holes, see FIG. 5) in the lower end thereof or ventilation holes (not shown), or can be made from permeable or impermeable materials.

Any thickness of material may be utilized in accordance with the present invention as long as the sleeves may be formed as described herein, and as long as the formed sleeves may contain at least a portion of a pot 42 or potted plant or floral grouping 36, as described herein. Additionally, an insulating material such as bubble film, preferable as one of two or more layers, can be utilized in order to provide additional protection for the item, such as the floral grouping 36, contained therein.

The material from which the sleeves 10–10*f* described herein are constructed preferably has a thickness in a range from about 0.1 mil to about 30 mils. Often, the thicknesses of the sleeves are in a range from about 0.5 mil to about 10 mils or preferably, in a range from about 1.0 mil to about 5 mils. More preferably, the sleeves 10–10*f* are constructed from a material which is flexible, semi-rigid, rigid, or any combination thereof. The sleeves 10–10*f* may be constructed of a single layer of material or a plurality of layers of the same or different types of materials. The layers of material comprising the sleeves 10–10*f* may be connected together or laminated or may be separate layers. Such materials used to construct the sleeves 10–10*f* are described in U.S. Pat. No. 5,111,637, which is hereby expressly incorporated herein by reference.

The sleeves 10–10*f* are constructed from any suitable material that is capable of being formed into a sleeve and wrapped about the pot 42 with or without the floral grouping 36 (or a floral grouping 36 alone) disposed therein. Preferably, the material comprises treated or untreated paper, metal foil, polymeric film, non-polymeric film, woven or nonwoven fabric, or synthetic or natural fabric, cardboard, fiber, cloth, burlap, or laminations or combinations thereof.

In one embodiment, the sleeves 10–10*f* contemplated herein may be constructed from sheets comprising two polypropylene films. The material comprising the sleeves 10–10*f* may be connected together or laminated or may be separate layers. In an alternative embodiment, the sleeves 10–10*f* may be constructed from only one sheet of the polypropylene film.

The term "polymeric film" means a synthetic polymer such as a polypropylene or a naturally occurring polymer such as cellophane. A polymeric film is relatively strong and not as subject to tearing (substantially non-tearable), as might be the case with paper or foil.

The materials comprising the sleeves 10–10*f* may vary in color and as described herein may consist of designs or decorative patterns which are printed, etched, and/or embossed thereon using inks or other printing materials. An example of an ink which may be applied to the surface of the material is described in U.S. Pat. No. 5,147,706, which is hereby expressly incorporated herein by reference.

In addition, the material may have various colorings, coatings, flocking and/or metallic finishes, or other decorative surface ornamentation applied separately or simultaneously or may be characterized totally or partially by pearlescent, translucent, transparent, iridescent, neon, or the like, qualities. The material may further comprise, or have applied thereto, one or more scents. Each of the above-named; characteristics may occur alone or in combination. Moreover, portions of the material used in constructing the sleeves 10–10*f* may vary in the combination of such characteristics. The material utilized for the sleeves 10–10*f* may be opaque, translucent, transparent, or partially clear or tinted transparent.

The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. As noted earlier, the floral grouping 36 comprises the bloom (or foliage) portion 40 and the stem portion 38. Further, the floral grouping 36 may comprise a growing potted plant having a root portion (not shown) as well. However, it will be appreciated that the floral grouping 36 may consist of only a single bloom or only foliage, or a botanical item, or a propagule. The term "floral grouping" may be used interchangeably herein with the term "floral arrangement". The term "potted plant" generally refers to the floral grouping 36 and the pot 42, along with a growing medium. The term "floral grouping" may also be used interchangeably herein with the terms "botanical item" and/or "propagule".

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as a bouquet or a floral grouping. The term "propagule" when used herein means any structure capable of being propagated or acting as an agent of reproduction including seeds, shoots, stems, runners, tubers, plants, leaves, roots, or spores.

In accordance with the present invention a bonding material (not shown) may optionally be disposed on a portion of any of the sleeves 10–10*f* described herein to attach each sleeve 10–10*f* to the pot 42 having a floral grouping 36 therein and disposed within the sleeve 10–10*f*. The bonding material may alternatively be a band, tie, string, ribbon, wire, tape, heat shrinkable material or other tying or banding device which may be constructed within or attached to the sleeve 10–10*e* before it is applied about the pot or floral grouping or may be provided only after the sleeve 10–10*e* is applied about the pot or floral grouping. A separate bonding material may also assist in closing or sealing the upper portion (when present) of the sleeve 10–10*e* or in adhering the sleeve 10–10*e* to the pot after the pot has been disposed therein. Examples of how a bonding material may be disposed on the sleeve are shown in U.S. Pat. Nos. 5,493,809 and 5,625,979, both of which are hereby expressly incorporated herein by reference in their entirety.

The term "detaching element" when used generally herein, means any element or device such as, but not limited to, perforations, tear strips, zippers, and any other devices or elements of this nature known in the art, or any combination thereof, which enable the tearing away or detachment of one object from another. Therefore, while perforations are shown and described in detail herein, it will be understood that tear strips, zippers, or any other "detaching element" known in the art, or any combination thereof, could be substituted therefore and/or used therewith.

The upper portions 50*c*, 50*d* or 50*f* of the sleeves 10*c*, 10*d* and 10*f*, respectively, may also have an additional substantial vertically disposed detaching element comprising a plurality of vertical perforations (not shown but well known in the art) for facilitating removal of the upper portion 50*c*, 50*d* or 50*f* thereof from the lower portion 52*c*, 52*d* or 52*f*, respectively.

As indicated above, it will be understood by a person of ordinary skill in the art that equipment and devices for forming floral sleeves are commercially available, and are well known to a person of ordinary skill in the art. Further detailed discussion of the construction of the sleeves described herein therefore is not deemed necessary. However, briefly, the sleeves described herein may be formed by intermittently advancing two separate webs, one or two webs preformed in the form of a tube, or a single web folded double and sealing the longitudinal sides and bottom portions of the two facing panels then cutting the sleeve thus formed from the webs or web. Machines which can form sleeves from such single webs or pairs of webs are well within the knowledge of one of ordinary skill in the art.

As noted above, any of the sleeves 10–10*f* contemplated herein may have lower ends 24–24*f* which are open or closed. When the lower end 24–24*f* is closed, the lower end 24–24*f* may have one or more gussets 52 as described elsewhere herein formed therein for allowing expansion of the lower end 24–24*f* when an object with a broad lower end such as the pot 42 is disposed therein. In another version, the sleeve 10–10*f* may comprise a flap (not shown) which can be folded over and sealed with a bonding material to close the sleeve 10–10*f*.

The term "pot" or "flower pot" as used herein refers to any type of container used for holding a floral grouping or plant, including vases. Examples of pots, used in accordance with the present invention include, but not by way of limitations, clay pots, wooden pots, foam pots, plastic pots, pots made from natural and/or synthetic fibers, and/or any combination thereof. The pot 42 is adapted to receive the floral grouping 36 in a retaining space thereof. The floral grouping 36 may be disposed within the pot 42 along with a suitable growing medium described elsewhere herein, or other retaining medium, such as a floral foam. It will also be understood that the floral grouping 36, and any appropriate growing medium or other retaining medium, maybe disposed in the sleeve 10–10*f* without the pot 42 for cultivating the floral grouping 36 or botanical item or displaying the grown floral grouping 36 or botanical item.

It should also be noted that for all versions of sleeves described above which have a bonding material thereon, it may be desirable to have a release material or cover strip covering the adhesive or cohesive bonding material disposed on any portion of such sleeves for preventing the bonding material from bonding to another surface until such is desired further, in each of the cases described herein wherein a sleeve 10–10*f* is applied to a pot 42, the sleeve 10–10*f* may be applied thereto either by depositing the pot 42 downwardly into the opened sleeve 10–10*f*, or the sleeve 10–10*f* may be brought upwardly about the pot 42 from below the pot 42.

It should be further noted that various features of the versions of the present invention such as closure bonding areas, support apertures, handles or handle apertures, additional perforations, drainage elements, ventilation holes, combinations of material may be used alone or in combination as elements of any of the embodiments described above herein.

Changes may be made in the construction and the operation of the various components, elements and assemblies described herein or in the steps or the sequence of steps of the methods described herein without departing from the spirit and scope of the invention as defined in the following claims.

what is claimed is:

1. A method of wrapping a pot or floral grouping, comprising:

providing a sleeve initially constructed in a flattened condition, the sleeve comprising:

an outer peripheral surface, a first sidewall edge, a second sidewall edge, an upper end having an upper edge, a lower end having a lower edge, an inner peripheral surface, and an inner space, wherein the lower edge has a first concave edge extending from the first sidewall edge, and a second concave edge extending from the second sidewall edge, with the first concave edge and the second concave edge meeting generally near a terminal end of the lower end, and wherein the first concave edge and the second concave edge are curved inwardly toward the inner space of the sleeve;

opening the sleeve to expose the inner space thereof; and disposing a pot or floral grouping into the inner space of the sleeve.

2. The method of claim 1 wherein in the step of providing a sleeve, the sleeve has a generally frustoconical shape when opened from the flattened condition.

3. The method of claim 1 wherein in the step of providing a sleeve, the sleeve comprises a gusset in the lower end.

4. The method of claim 1 wherein in the step of providing a sleeve, the sleeve comprises an upper portion, a lower portion, and a detaching element for detaching the upper portion from the lower portion.

5. The method of claim 4 wherein in the step of providing a sleeve, the detaching element comprises perforations in the sleeve.

6. The method of claim 4 wherein in the step of providing a sleeve, the detaching element has a non-linear pattern such that when the upper portion is detached, the lower portion is left with an upper end having a non-linear upper edge.

7. The method of claim 4 wherein in the step of providing a sleeve, the detaching element has a linear pattern such that when the upper portion is detached, the lower portion is left with an upper end having a linear upper edge.

8. The method of claim 4 wherein in the step of providing a sleeve, the upper portion is sized to substantially surround and enclose a floral grouping designed within the sleeve.

9. The method of claim 4 wherein in the step of providing a sleeve, the upper portion is adapted to support the sleeve from a support assembly.

10. The method of claim 1 wherein in the step of providing a sleeve, the sleeve further comprises a skirt portion.

11. The method of claim 1 wherein in the step of providing a sleeve, the upper edge is a non-linear upper edge.

12. The method of claim 1 wherein in the step of providing a sleeve, the upper edge is a generally linear upper edge.

13. A method of wrapping a pot or floral grouping, comprising:

providing a sleeve initially constructed in a flattened condition, the sleeve comprising:

an outer peripheral surface, a first sidewall edge, a second sidewall edge, an upper end having an upper edge, a lower end having a lower edge, an inner peripheral surface, and an inner space, wherein the lower edge has a first concave edge extending from the first sidewall edge, and a second concave edge extending from the second sidewall edge, with the first concave edge and the second concave edge meeting generally near a terminal end of the lower end, and wherein the first concave edge and the second concave edge are curved inwardly toward the inner space of the sleeve, and the sleeve further having a detaching element extending from the first sidewall edge to the second sidewall edge for detaching an upper portion of the sleeve from a lower portion of the sleeve;

opening the sleeve to expose the inner space thereof; and disposing a pot of floral grouping into the inner space of the sleeve.

14. The method of claim 13 wherein in the step of providing a sleeve, the sleeve has a generally frustoconical shape when opened from the flattened condition.

15. The method of claim 13 wherein in the step of providing a sleeve, the sleeve comprises a gusset in the lower end.

16. The method of claim 13 wherein in the step of providing a sleeve, the detaching element comprises perforations in the sleeve.

17. The method of claim 13 wherein in the step of providing a sleeve, the detaching element has a non-linear pattern such that when the upper portion is detached, the lower portion is left with an upper end having a non-linear upper edge.

18. The method of claim 13 wherein in the step of providing a sleeve, the detaching element has a linear pattern such that when the upper portion is detached, the lower portion is left with an upper end having a linear upper edge.

19. The method of claim 13 wherein in the step of providing a sleeve, the upper portion is sized to substantially surround and enclose a floral grouping designed within the sleeve.

20. The method of claim 13 wherein in the step of providing a sleeve, the upper portion is adapted to support the sleeve from a support assembly.

21. The method of claim 13 wherein in the step of providing a sleeve, the sleeve further comprises a skirt portion.

* * * * *